US006746255B1

(12) United States Patent
Lee et al.

(10) Patent No.: US 6,746,255 B1
(45) Date of Patent: Jun. 8, 2004

(54) SERIAL ATA CABLE ASSEMBLY

(75) Inventors: George Lee, Irvine, CA (US); William E. Spink, Jr., Laguna Niguel, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/632,476

(22) Filed: Aug. 1, 2003

(51) Int. Cl.[7] ..... H01R 13/648

(52) U.S. Cl. ..... 439/108; 439/701; 439/579; 439/499

(58) Field of Search ..... 439/108, 701, 439/540.1, 497, 579, 606, 695, 499, 610, 564, 731, 686

(56) References Cited

U.S. PATENT DOCUMENTS 4,343,528 A * 8/1982 Lucius et al. ..... 439/601
5,513,995 A * 5/1996 Kurotori et al. ..... 439/64
5,934,942 A * 8/1999 Patel et al. ..... 439/610
6,200,171 B1 * 3/2001 Fusselman et al. ..... 439/736
6,206,731 B1 * 3/2001 Kuo ..... 439/610
6,273,753 B1 * 8/2001 Ko ..... 439/579
6,402,552 B1 6/2002 Wagner
6,489,563 B1 12/2002 Zhao et al.
6,494,749 B1 12/2002 Chang
6,648,676 B1 * 11/2003 Lee ..... 439/499
2002/0173191 A1 11/2002 I-Tse
2003/0096517 A1 5/2003 Ho

* cited by examiner

*Primary Examiner*—P. Austin Bradley
*Assistant Examiner*—Edwin A. León
(74) *Attorney, Agent, or Firm*—Wei Te Chung

(57) ABSTRACT

A Serial Advanced Technology Attachment (SATA) cable assembly (100), includes an insulative housing (10) having a SATA interface, a plurality of contacts (20) retained in the insulative housing, a plurality of standard SATA cables (32) each standard SATA cable having two differential pairs (320) electrically connecting to the contacts, and a plurality of single wires (33) electrically connecting to the contacts and locating between two standard SATA cables for transmitting low speed signals or power.

1 Claim, 8 Drawing Sheets

SERIAL ATA CABLE ASSEMBLY

CROSS-REFERENCE TO RELATED APPLICATIONS

The subject matter of this patent application is pertinent to contemporaneously filed U.S. Patent Applications entitled "SERIAL ATA CONNECTOR WITH COMPLIANT CONTACT" and entitled "SERIAL ATA CONNECTOR WITH RIGHT ANGLE CONTACT", all invented by the same inventor and assigned to the same assignee as this patent application.

BACKGROUND OF THE INVENTION

1. Field of the Invention

The present invention generally relates to a Serial Advanced Technology Attachment (Serial ATA) cable assembly, and more particularly to a SATA cable assembly having a plurality of standard SATA cables and a plurality of single wires.

2. Description of Related Art

Currently, most computers have a storage device called a hard drive. A hard drive is connected to the computer by way of an interface, usually a controller card, a cable, and some software protocols. One type of hard drive interface used today is an integrated drive electronics (IDE) interface. This is also known as an advanced technology attachment (ATA) interface. ATA is the actual interface specification for the IDE standard. The current IDE/ATA standard is a parallel interface whereby multiple bits of data are transmitted at one time across the interface simultaneously during each transfer. A parallel interface allows for high throughput, however, as the frequency of the interface is increased, signaling problems and interference between signals become common.

Serial Advanced Technology Attachment (SATA) is an interface specification that abandons the parallel concept in favor of a serial interface where only one bit is transferred at a time. This allows the interface to operate at higher speeds without the problems associated with a parallel interface at higher speeds. As computer processor performance has increased, so have the read/write data rates of hard disk drive heads and media. Serial ATA eliminates bottlenecks that occur in parallel AT interfaces.

Currently, SATA connectors are only single position seven pin connectors. Today, not only are processor speeds increasing, but the amount of space that a computer fits into is shrinking. Therefore, the motherboards or printed circuit boards (PCB) that hold the electronics and other devices for a computer have limited space. In a computer which may contain multiple hard drives, multiple SATA connectors and SATA cable assemblies may need to reside on the printed circuit board and occupy the space of the computer. This takes up considerable space, depending on the number of hard disk drives and associated SATA connectors.

Therefore, there is a need for integrating overall SATA connector interfaces into one interface that saves computer space and simplifies the assembly and manufacturing of the SATA connector.

SUMMARY OF THE INVENTION

An object of the present invention is to provide a SATA cable assembly for saving computer space.

Another object of the present invention is to provide a SATA cable assembly for achieving a more reliable high speed signals and low speed signals transmission.

In order to achieve the objects set forth, a SATA cable assembly in accordance with the present invention comprises an insulative housing having a SATA interface, a plurality of contacts retained in the insulative housing, a plurality of standard SATA cables each standard SATA cable having two differential pairs electrically connecting to the contacts, and a plurality of single wires electrically connecting to the contacts and locating between two standard SATA cables for transmitting low speed signals.

Other objects, advantages and novel features of the invention will become more apparent from the following detailed description when taken in conjunction with the accompanying drawings.

DETAILED DESCRIPTION OF THE INVENTION

Figure 1:
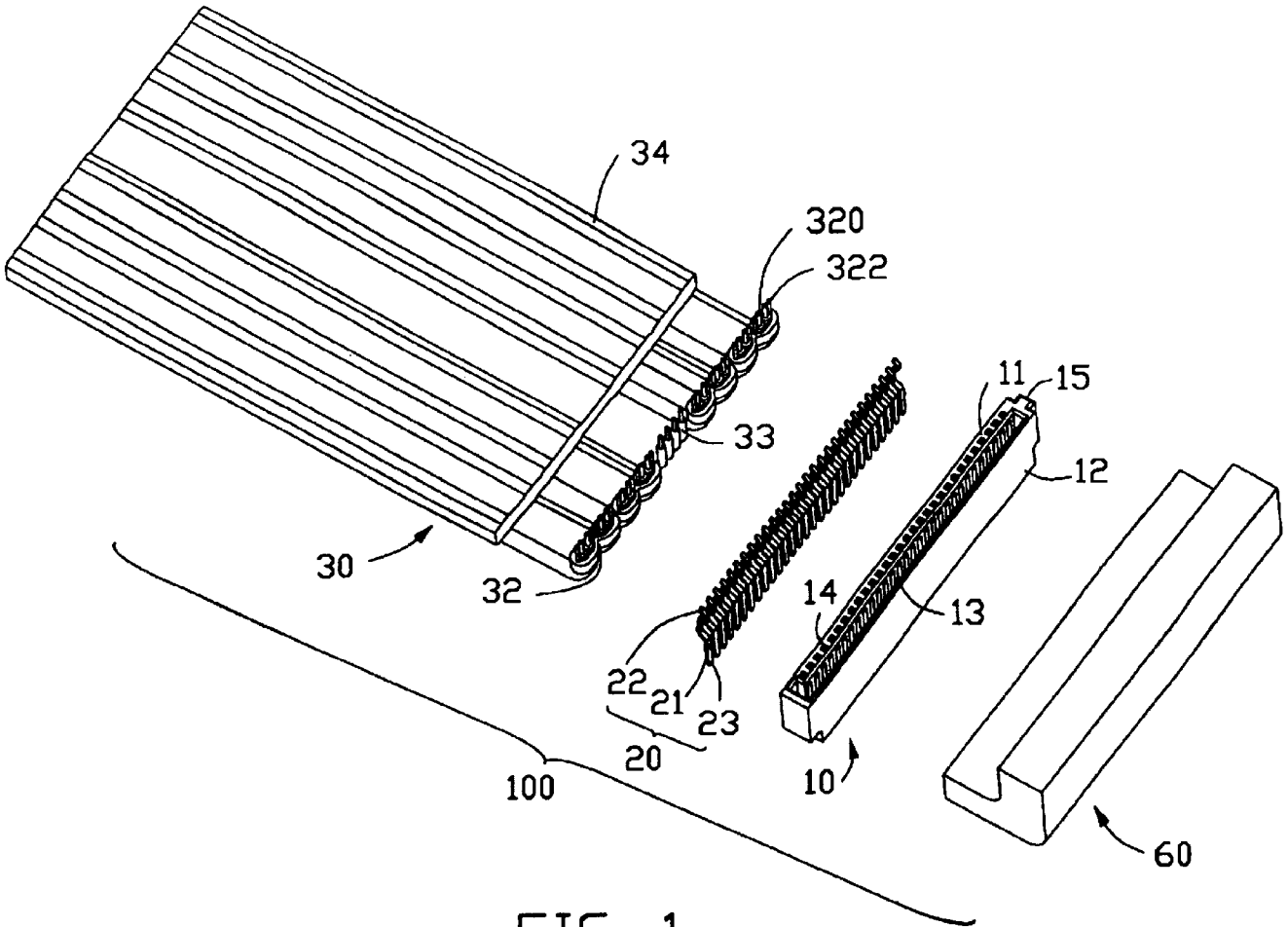
FIG. 1 is an exploded, perspective view of a SATA cable assembly in accordance with the present invention.
Figure 2:
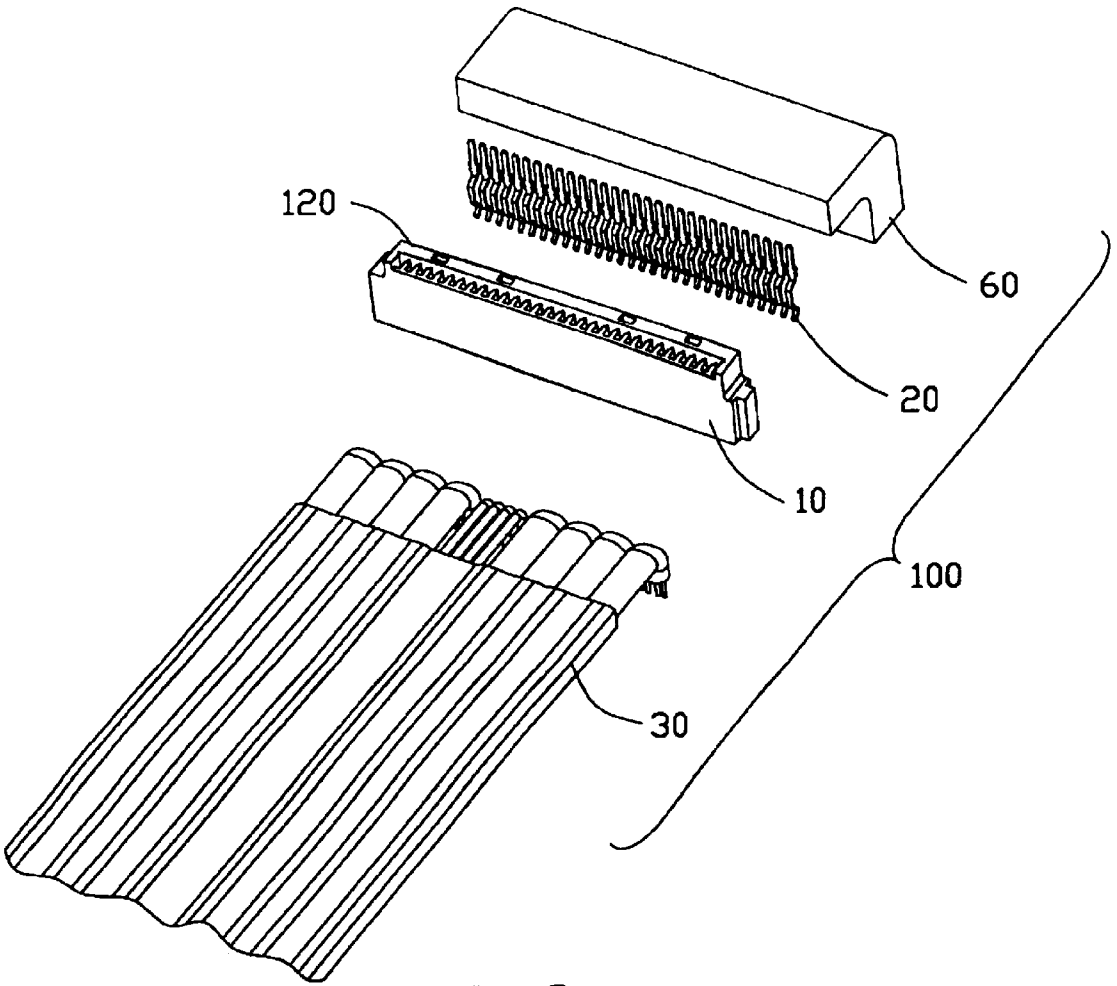
FIG. 2 is a view similar to FIG. 1, but taken from rear and bottom aspects.
Figure 3:
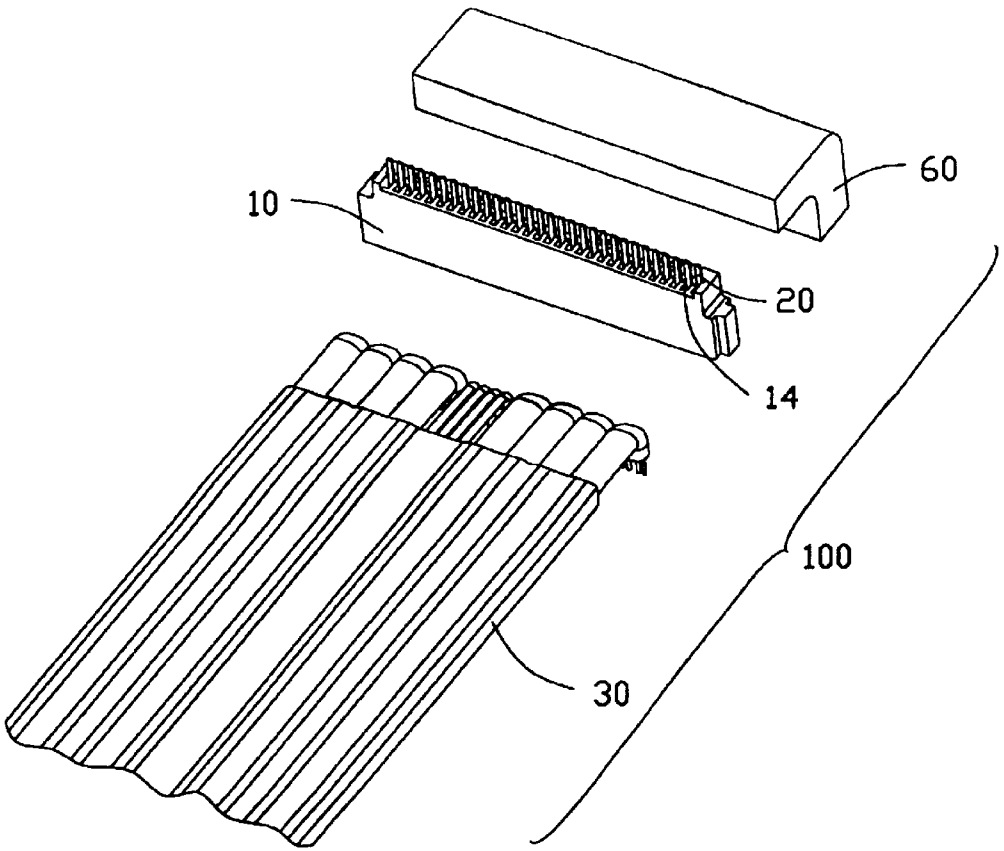
FIG. 3 is a partly assembled perspective view of the SATA cable assembly showing a plurality of contacts assembled into a housing.
Figure 4:
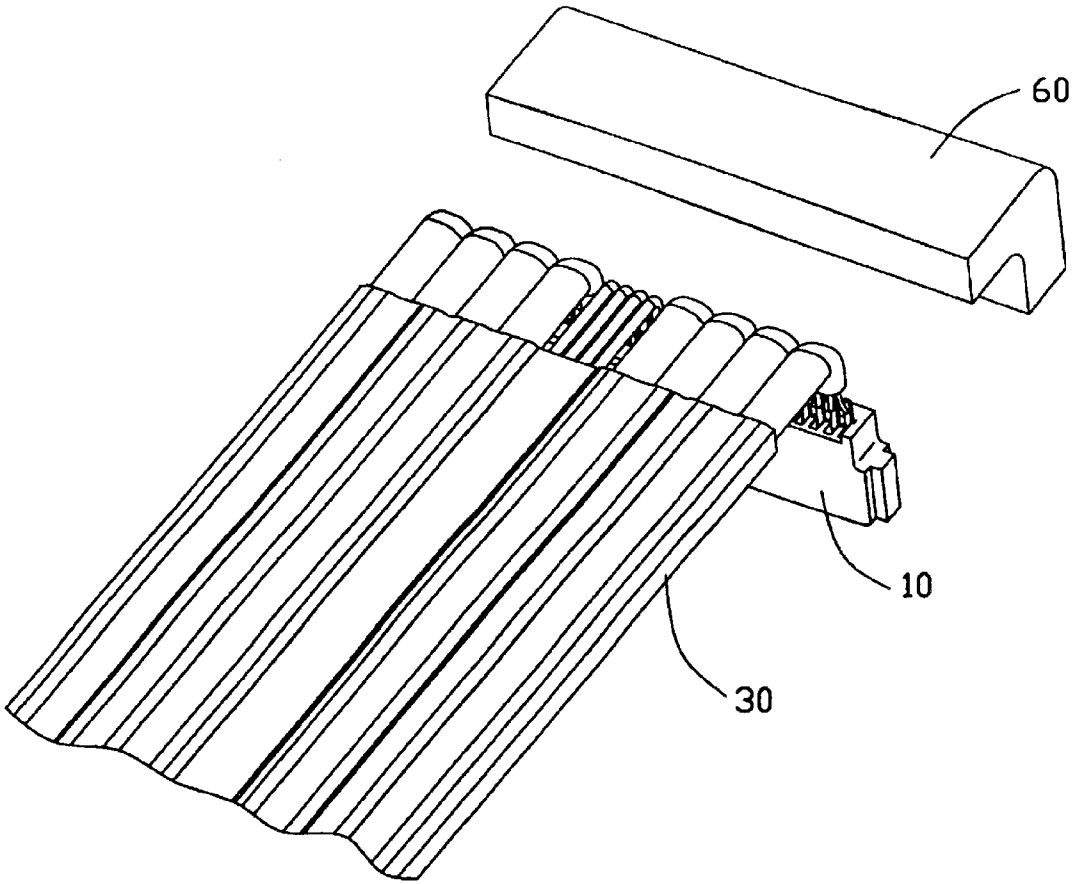
FIG. 4 is a partly assembled view of the SATA cable assembly showing a plurality of standard SATA cables and single wires assembled to the housing.
Figure 5:
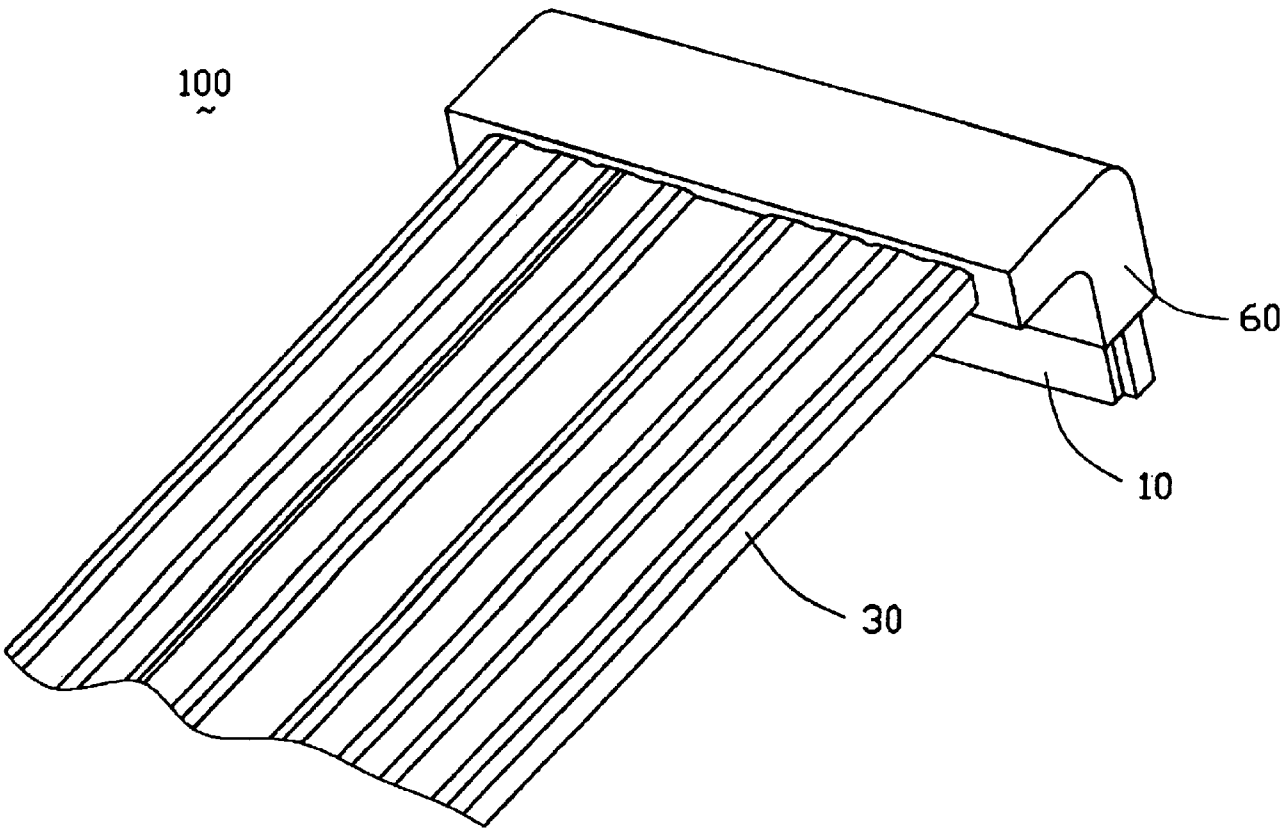
FIG. 5 is an assembled view of the SATA cable assembly of FIG. 2.
Figure 6:
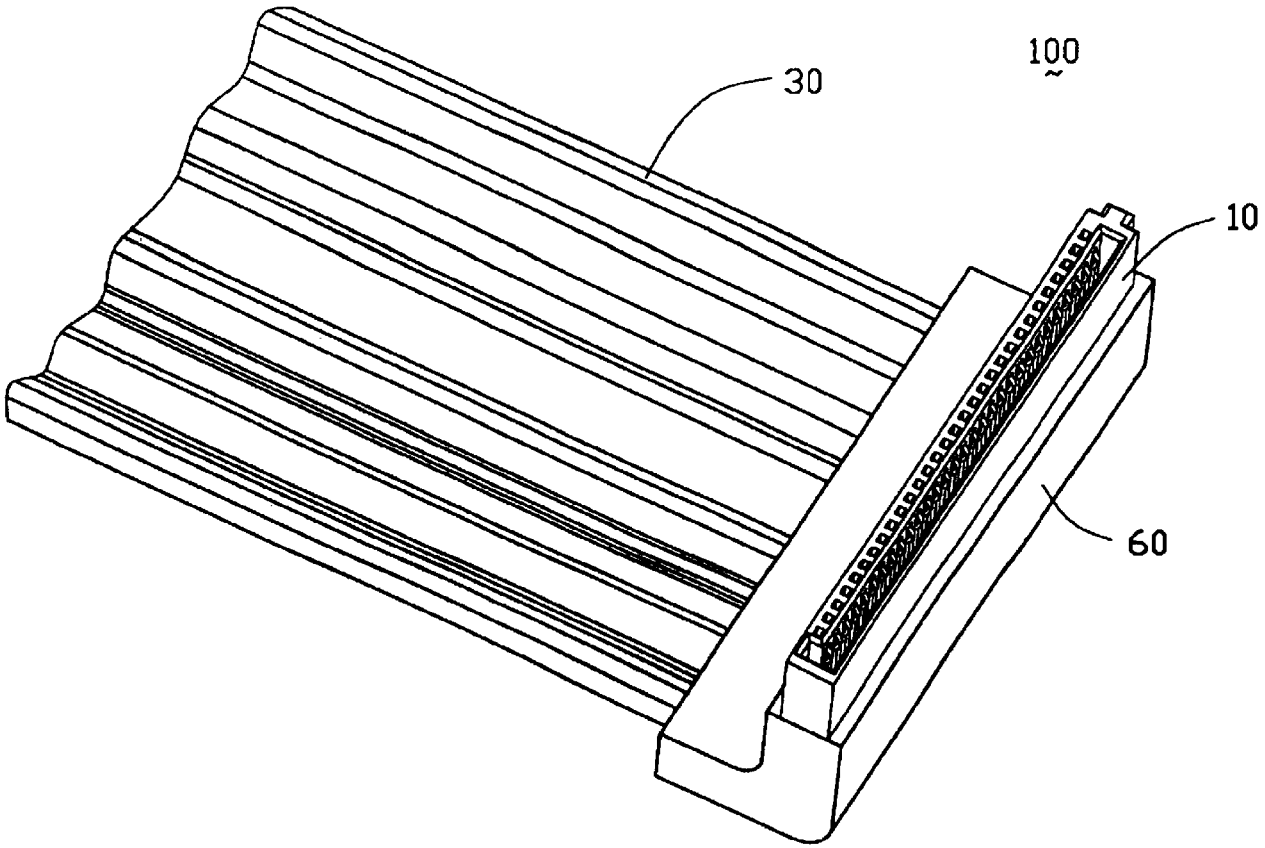
FIG. 6 is an assembled view of the SATA cable assembly of FIG. 1.

Referring to FIG. 1 and FIG. 2, a SATA cable assembly 100 in accordance with the present invention comprises an elongate insulative housing 10, a plurality of contacts 20, a cable 30, and a cover 60.

The elongate insulative housing 10 comprises a mating portion 11 and an opposite mounting portion 12. The mating portion 11 defines an L-shaped receiving space 13 in the elongate direction. A plurality of passageways 14 is defined in the housing 10 from a rear face 120 of the mounting portion 12 to the mating portion 11 and communicates with the receiving space 13. A block 15 is integrally formed on one end of the housing 10 for providing blind mating function.

Each contact 20 comprises a securing portion 21 at a middle thereof, an engaging portion 22 extending from one end of the securing portion 21, and a soldering portion 23 extending from the other end of the securing portion 21.

The cable 30 comprises a plurality of standard SATA cables 32 for transmitting high speed signals, a plurality of single wires 33 at a middle of the plurality of standard SATA cables 32 for transmitting low speed signal or power in accordance with the user request, and a PVC boot 34 enclosing outside of the standard SATA cables 32 and the single wires 33. Each standard SATA cable 32 comprises two differential pairs 320 and four grounding wires 322, and two of the grounding wires 322 are neighboring. The standard SATA cables 32 and the single wires 33 are bent in a right angle adjacent to the end of the cable 30.

Referring to FIGS. 3–6, in assembly, the contacts 20 are assembled into the passageways 14 of the housing from the mounting portion 12 to the mating portion 11 with each securing portion 21 securing with a pair of side walls (not labeled) of the passageway 14, the engaging portion 22 exposing to the receiving space 13, and the soldering portion 23 extending beyond the rear face 120 of the mounting portion 12. The stoppers 50 are assembled into the grooves 16 to seal the grooves 16. The differential pairs 320, the grounding wires 322, and the single wires 33 are soldered to the soldering portions 23 of the contacts 20 wherein the two neighboring grounding wires 322 are soldered to the same contact 20. A right angle cover 60 is over-molded on the mounting portion 12 and the front end of the cable 30 wherein connections between the standard SATA cables 32 and the single wires 33 are enclosed and protected by the cover 60.

Figure 7:
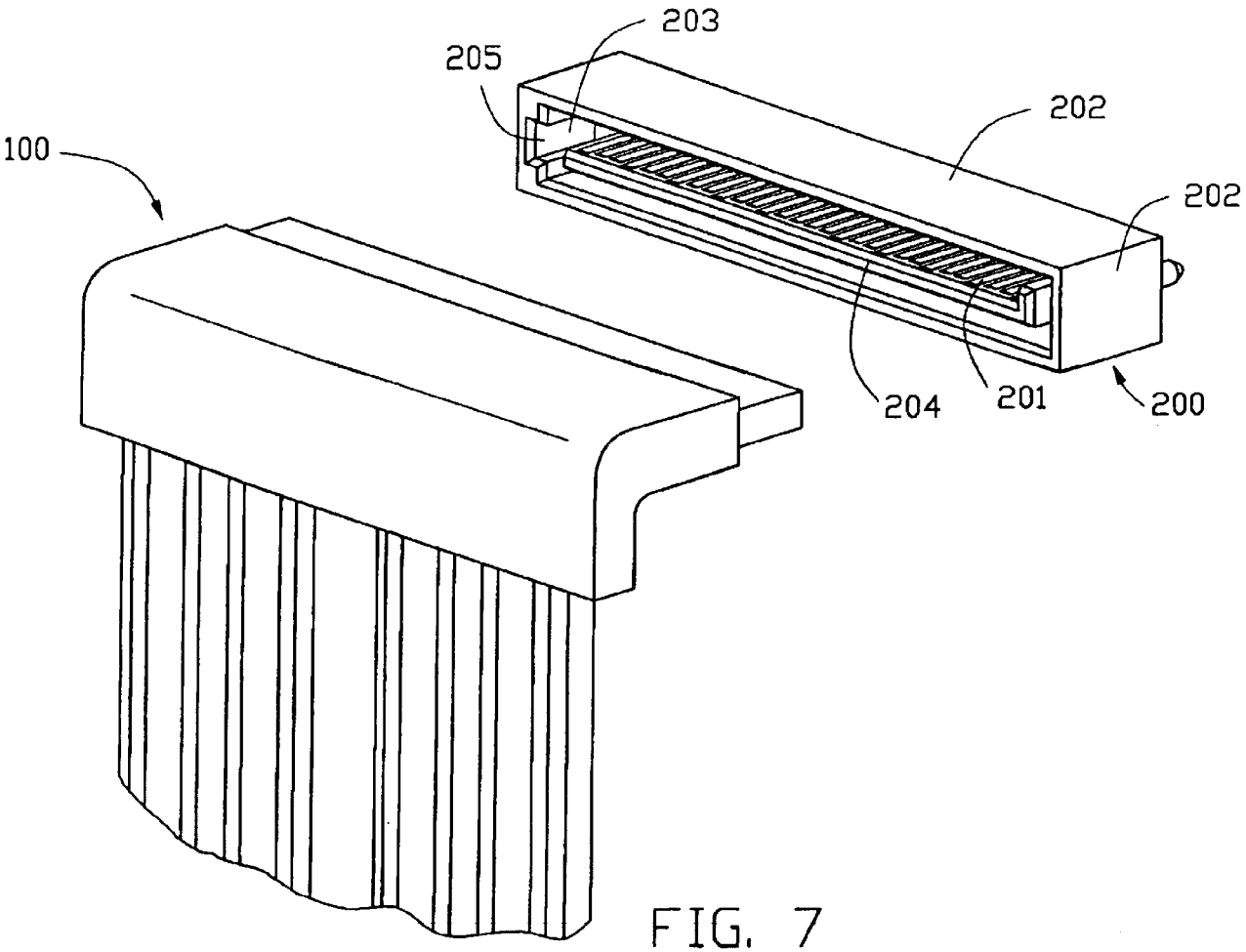
FIG. 7 is a perspective view of the SATA cable assembly of FIG. 6 and a first complementary SATA connector with compliant type contact.

Referring to FIG. 7, the SATA cable assembly 100 has a first complementary SATA connector 200 which has a plurality of compliant (press-fit) type contacts 201. The first complementary SATA connector 200 comprises four side walls 202 together defining a mating space 203, an L-shaped tongue 204 extending in the mating space 203. The plurality of compliant type contacts 201 is assembled to the L-shaped tongue 204. A slot 205 is defined in one side wall 202. When the SATA cable assembly 100 mates with the first complementary SATA connector 200, the L-shaped tongue 204 is received into the L-shaped receiving space 13, the mating portion 11 of the SATA cable assembly is received into the mating space 203, the block 15 is received into the slot 205.

Figure 8:
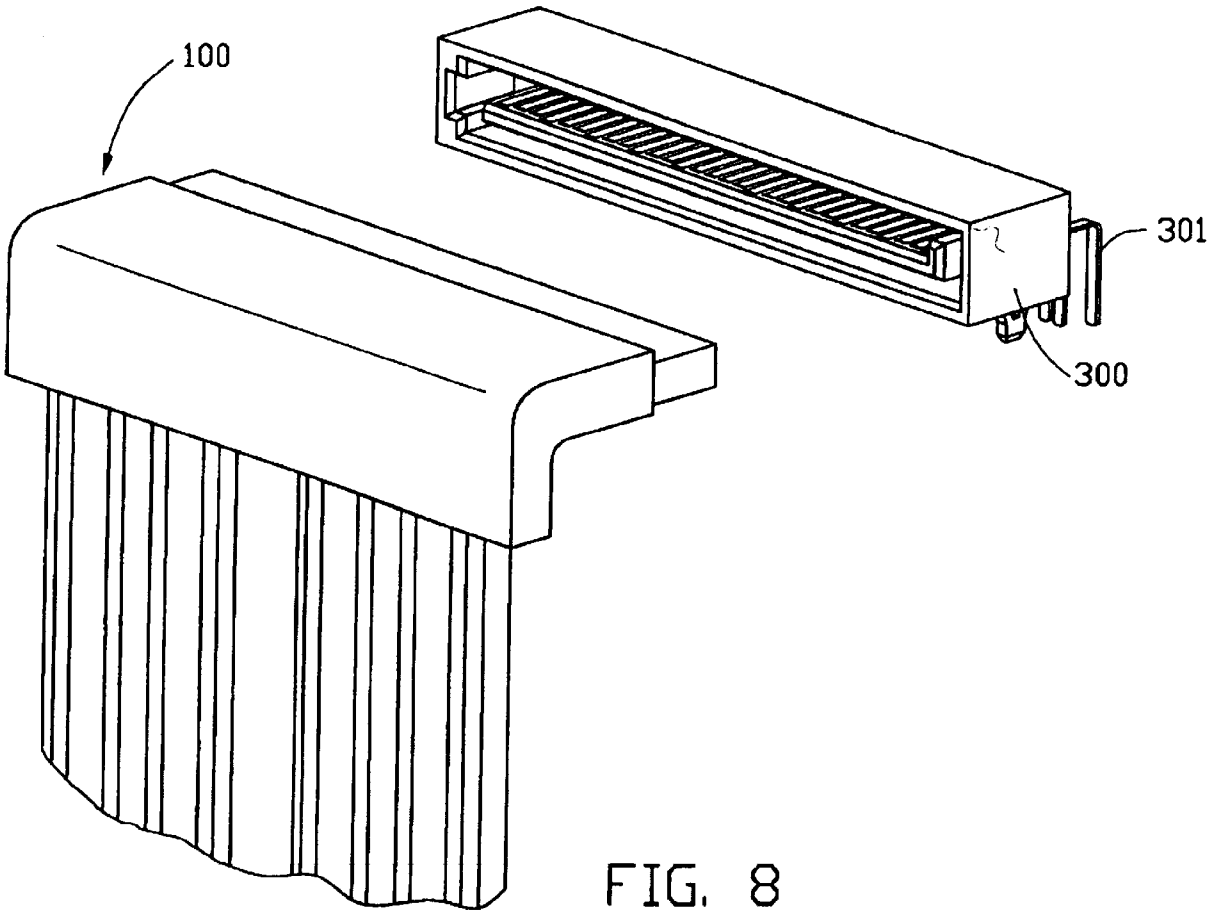
FIG. 8 is a perspective view of the SATA cable assembly of FIG. 6 and a second complementary SATA connector with right angle type contacts.

Referring to FIG. 8, the SATA cable assembly 100 has a second complementary SATA connector 300 which has a same configuration with that of the first complementary SATA connector 200 except a plurality of right angle type contacts 301.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Serial Advanced Technology Attachment (SATA) cable assembly, comprising:

an insulative housing having a SATA interface;

a plurality of contacts retained in the insulative housing;

a plurality of standard SATA cables each having two differential signal pairs electrically connecting to the contacts for transmitting high speed signals; and a plurality of single wires electrically connecting to the contacts and located between two standard SATA cables for transmitting low speed signals each standard SATA cable further comprises four grounding wires, and two of the grounding wires are neighboring and electrically connected to same contact, all plurality of standard SATA cables and single wires are bent in a right angle at positions adjacent to connections between the contacts and the standard SATA cables and single wires, a right angle cover encloses a mounting portion of the housing and the connections between the contacts and the standard SATA cables and the single wires, the housing comprises a mating portion opposite to the mounting portion, a plurality of passageways is defined in the housing from a rear face of the mounting portion to the mating portion, an L-shaped receiving space is defined in the mating portion and communicates with the passageways, and the contacts are retained in the passageways and exposed in the L-shaped receiving space, a boot is utilized to package the standard SATA cables and the single wires, four standard SATA cables are provided and the single wires are located in the center of four standard SATA cables.

* * * * *